US007409831B2

(12) United States Patent
Lepretre

(10) Patent No.: US 7,409,831 B2
(45) Date of Patent: Aug. 12, 2008

(54) PROVISION OF SEALING IN A JET ENGINE FOR BLEEDING AIR TO THE CABIN USING A TUBE WITH A DOUBLE BALL JOINT

(75) Inventor: Gilles Lepretre, Epinay Sous Senart (FR)

(73) Assignee: SNECMA, Paris (FR)

( * ) Notice: Subject to any disclaimer, the term of this patent is extended or adjusted under 35 U.S.C. 154(b) by 808 days.

(21) Appl. No.: 10/938,574

(22) Filed: Sep. 13, 2004

(65) Prior Publication Data

US 2005/0097899 A1 May 12, 2005

(30) Foreign Application Priority Data

Sep. 22, 2003 (FR) ..... 03 11064

(51) Int. Cl.
*F02C 7/00* (2006.01)

(52) U.S. Cl. ..... 60/785; 60/751

(58) Field of Classification Search ..... 60/785, 60/751, 782, 795; 415/144, 145
See application file for complete search history.

(56) References Cited

U.S. PATENT DOCUMENTS 4,554,789 A * 11/1985 Napoli et al. ..... 60/751
4,870,826 A 10/1989 Daguet et al.
6,783,324 B2 * 8/2004 Muny ..... 415/144
6,843,059 B2 * 1/2005 Burrus et al. ..... 60/751
7,040,098 B2 * 5/2006 Lepretre et al. ..... 60/799
2005/0056025 A1 * 3/2005 Lepretre et al. ..... 60/785

FOREIGN PATENT DOCUMENTS

EP 0 162 340 11/1985
EP 1 247 944 A2 10/2002

* cited by examiner

*Primary Examiner*—Devon Kramer
*Assistant Examiner*—Vikansha Dwivedi
(74) *Attorney, Agent, or Firm*—Oblon, Spivak, McClelland, Maier & Neustadt, P.C.

(57) ABSTRACT

A jet engine that provides for the sealing of bleeding air to the cabin, the air passing through a cavity delimited, on the one hand, by the external shell of the compressor and an annular structure connected to the shell, and, on the other hand, by the external casing of the diffuser grating and a strut connected to the external casing and to an external engine casing shell, this external casing shell being fastened to the annular structure by bolting. A tube is provided between the orifice in the strut and the outlet vent, a first end of which tube is mounted in the outlet vent by a connection which is free to rotate and prevented from translational movement, and a second end of which tube is mounted in the orifice by a connection which is free to rotate and free to move translationally.

8 Claims, 3 Drawing Sheets

PROVISION OF SEALING IN A JET ENGINE FOR BLEEDING AIR TO THE CABIN USING A TUBE WITH A DOUBLE BALL JOINT

BACKGROUND OF THE INVENTION

1. Field of the Invention

The invention relates to a jet engine comprising, from upstream to downstream (the upstream and downstream directions being defined by the direction of circulation of the primary flow), a high-pressure compressor, a diffuser grating and a combustion chamber, said high-pressure compressor comprising an external shell which radially delimits the duct for said primary flow and is connected to an annular structure extending radially outward, said diffuser grating comprising in the axial continuation of said external compressor shell an external casing connected to a rearwardly oriented conical strut delimiting, upstream, the end of said combustion chamber, said strut itself being connected to an external casing shell which extends in the upstream direction and is fastened to said annular structure by fastening means, said strut, said external casing shell and said annular structure defining a cavity around said diffuser grating, air bleed orifices being made in said strut in order to bring the end of the combustion chamber into communication with said cavity, and said external casing shell being equipped with outlet vents for the bled air.

2. Discussion of the Background

Air required for the cabin of the airplane equipped with at least one jet engine is bled off at the end of the combustion chamber in a region where it has the least disruptive effect on the overall efficiency of the engine. Bleeding takes place through the orifices in the strut, which makes it easy to install the outlet vents for the bled air. This arrangement requires relative sealing between the duct of the high-pressure compressor and the cavity situated above the grating of the diffuser.

This sealing is all the more difficult to achieve because the relative displacements between the diffuser grating and the external shell of the compressor are of the order of 1.5 mm in the axial direction and substantially of the same order in the radial direction, owing to the thermal and mechanical responses of the various components in an environment subjected to high pressures which may reach 30 bar and to high temperatures which may reach 650° C.

The current technology adopted to provide sealing between the compressor and the external casing of the grating is of the type comprising a seal made up of a strip and counterseal with springs pressing against these. This technology in fact allows a sufficiently large displacement between the two components.

The prior art is illustrated by FIG. 1, which shows the last stage of a high-pressure compressor 1 of a jet engine having, from upstream to downstream in the direction of the primary flow Fl, a ring of fixed vanes 2 extending radially inward from an external casing 3, followed by a ring of moving blades 4 mounted at the periphery of a compressor wheel 5 and extending outward as far as an external compressor shell 6 which, together with the external casing 3, radially delimits the duct for the primary flow, this external shell 6 being connected to an annular structure 7 which has a V-shaped cross section in the plane containing the axis of the jet engine and extending radially outward and is fastened to the external casing of the engine by bolting.

Provided downstream of the compressor 1 is a diffuser grating 10 which receives the compressed air from the compressor 1 and delivers it toward a combustion chamber 11. In the axial continuation of the external shell 6 of the compressor 1, the grating 10 has an external casing 12 connected to a conical strut 13 oriented toward the rear of the jet engine, this strut 13 defining the upstream wall of the end of the combustion chamber 11 and being connected in its radially outer region to an external casing shell 14 which extends in the upstream direction and has an upstream flange 15 by means of which the assembly consisting of the combustion chamber and the diffuser can be fastened on a radially outer flange 16 of the annular structure 7 by bolting.

A cavity 20 surrounding the diffuser grating 10 is thus delimited axially by the annular structure 7 and the strut 13, radially outwardly by the external casing shell 14 and radially inwardly by the downstream portion 6*a* of the external compressor shell 6 and by the upstream portion 12*a* of the external casing 12, a gap 21 separating these two portions.

The strut 13 has air bleed orifices 22 at the end of the combustion chamber and the external casing shell 14 is equipped with outlet vents 23 to supply a flow of air for aerating the cabin of the airplane or for cooling other elements of the jet engine.

Sealing between the compressor duct and the cavity 20 is achieved, as is shown in detail in FIG. 2, by a sectorized seal made up of strips 30 lined with counterseals 31, this seal being mounted on the periphery of the upstream portion 12*a* of the external casing 12 of the diffuser grating. To this end, this upstream portion 12*a* has over its periphery a channel 32 delimited by two flanges, the upstream one having the reference 33*a* and the downstream one having the reference 33*b*, which flanges have holes drilled into them for fastening rivets 34. The strips 30 and the counterseals 31 are kept in bearing contact with the downstream face of the upstream flange 33*a* by means of springs 35 and are retained by the rivets 34. The springs 35 are likewise retained by the rivets 34. The radially internal portion of the annular structure 7 has an annular projection 40 which extends axially into the cavity 20 and the end of which is situated above the upstream flange 33*a* in the absence of any axial displacement between the external shell 6 of the compressor 1 and the external casing 12 of the diffuser, as is shown in FIG. 2.

The springs 35 bear on the seals in the annular region separating the projection 40 from the upstream flange 33*a*. Moreover, the air pressure in the cavity 20 is slightly greater than the pressure in the duct at the gap 21.

The bearing points for the seals 30 on the projection 40 side and on the upstream flange 33*a* side have convex surfaces. The combined forces of the springs 35 and the pressure difference across the two faces of the seals 30 press the strips 30, which are flat, against these surfaces in the configuration shown in FIG. 2, thus providing sealing.

In certain flight phases, the bearing between the strips 30 and the projection 40 leaves an escape clearance, especially when the projection 40 passes above the channel 32, as is shown in FIGS. 4 and 5. Between two consecutive springs, the strips 30 move away from the projection and only the pressure difference between the two faces, which is small, may prevent the creation of this separation. An escape clearance 41 is then formed between the strips and the end of the projection 40.

When, by contrast, the diffuser grating 10 moves away from the compressor 1, as can be seen in FIG. 3, the force due to the pressure difference and the force of the springs 35 allow correct sealing to be achieved, by deformation of the strips 30.

The double arrows shown in FIG. 2 indicate the relative axial and radial displacements between the downstream end of the external compressor shell 6 and the upstream end of the external casing 12 of the diffuser grating 10.

It should also be noted that the arrangement of this sealing system borne by the external casing 12 makes it possible for the combustion chamber/diffuser assembly to be assembled on the compressor by relative axial displacement of said assembly with respect to the compressor and then by bolting together the external flanges 15 and 16.

SUMMARY OF THE INVENTION

The aim of the invention is to propose a way of routing the air bled from the end of the combustion chamber between the orifice in the strut and the outlet vent, which makes it possible to avoid the necessity of making airtight the radially inner region of the cavity surrounding the grating of the diffuser.

The invention achieves its aim by virtue of the fact that a tube is provided between the orifice in the strut and the outlet vent, a first end of which tube is mounted in the outlet vent by means of a swivel connection which is free to rotate and prevented from translational movement, and a second end of which tube is mounted in the orifice in the strut by means of a swivel connection which is free to rotate and free to move translationally.

The flow of air in this tube is thus independent of the pressure variations in the cavity separating the stator of the compressor from the diffuser. It is influenced only by the pressure prevailing in the end of the combustion chamber in the bleed zone.

The first and second ends of the tube each comprise a spherical surface portion at their periphery.

The orifice in the strut is formed by a cylindrical bore whose diameter is substantially equal to the diameter of the spherical surface portion of the second end of the tube.

The outlet vent comprises an orifice made in the wall of the external casing shell, said orifice being delimited by a cylindrical portion situated toward the external face of said external shell and by a spherical surface portion situated toward the internal face and connected to the cylindrical surface portion, said cylindrical and spherical surface portions having a diameter which is substantially equal to the diameter of the spherical surface portion of the first tube end.

BRIEF DESCRIPTION OF THE DRAWINGS

Other advantages and features of the invention will emerge on reading the description below given by way of example and with reference to the appended drawings, in which:

FIG. 1 being a half-section, in a plane containing the axis of the jet engine, of the downstream part of a compressor and of the diffuser, which shows the layout of the cavity communicating with the end of the combustion chamber and from which air is bled for the cabin of the airplane, and the installation of the seal, according to the prior art, between this cavity and the duct for the primary flow;

FIG. 2 shows the arrangement of the seal according to the prior art on a larger scale;

FIG. 3 shows the deformation of the seal when there is an increase in the gap between the external shell of the compressor and the external casing of the grating of the diffuser;

FIG. 4 shows the deformation of this same seal when there is a reduction in this gap; and FIG. 5 is a perspective view of the seal when there is a reduction in the gap, which shows the escape clearance.

DETAILED DESCRIPTION OF THE PREFERRED EMBODIMENTS

FIGS. 1 to 5 have already been commented upon and do not require any further explanations.

Figure 1:
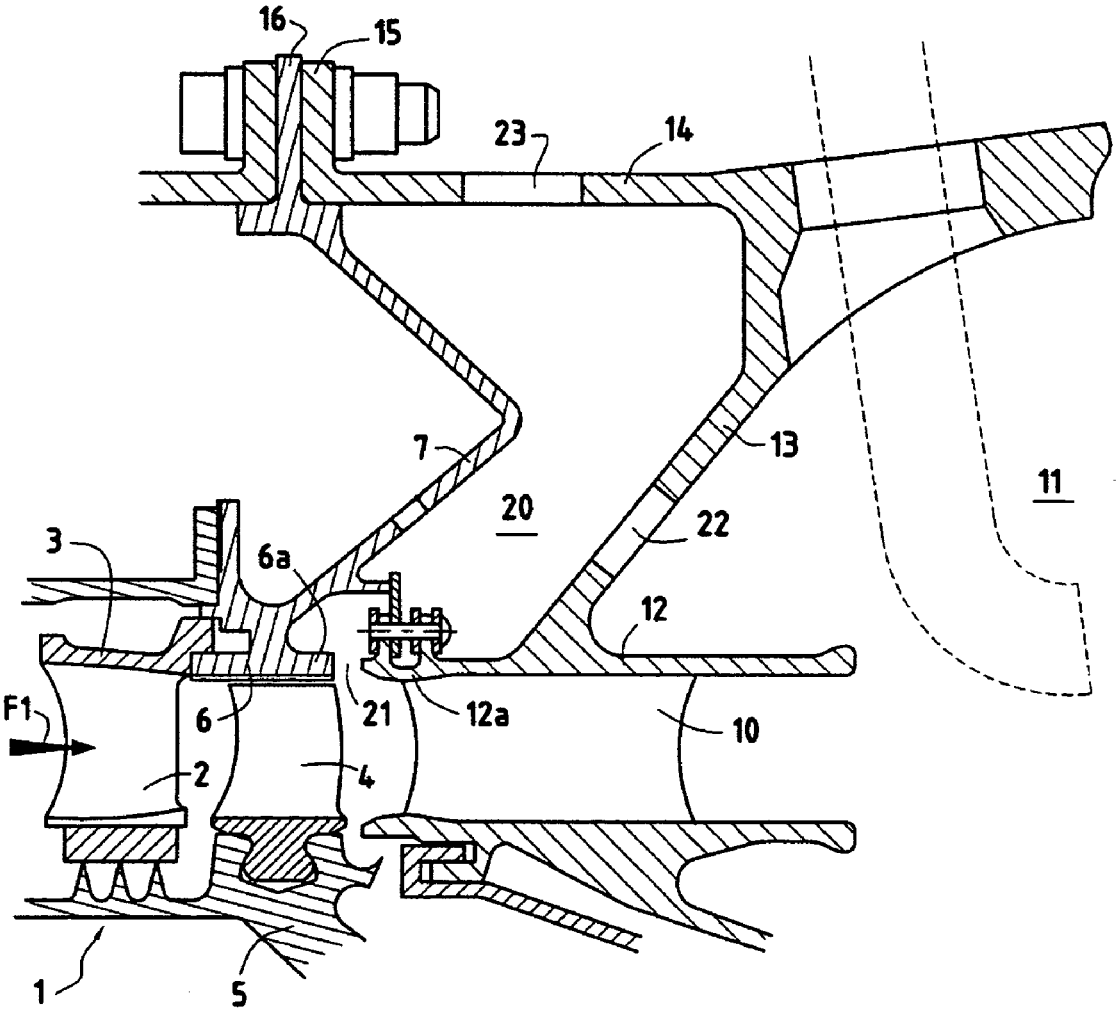
FIG.1 PRIOR ART
FIGS. 1 to 5 show the prior art.
Figure 2:
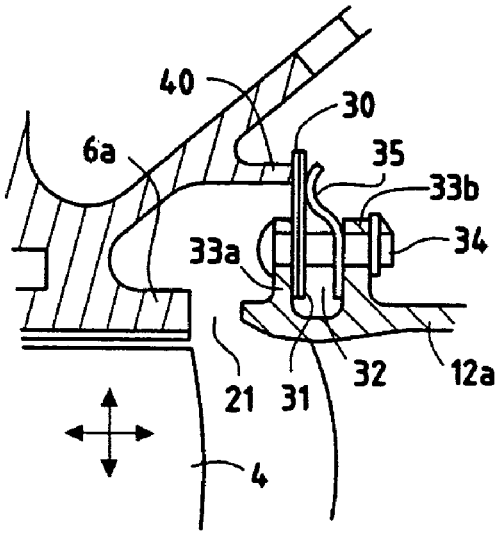
FIG.2 PRIOR ART
Figure 3:
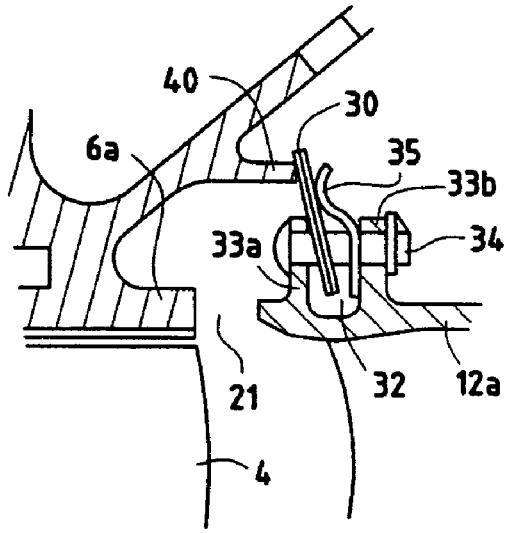
FIG.3 PRIOR ART
Figure 4:
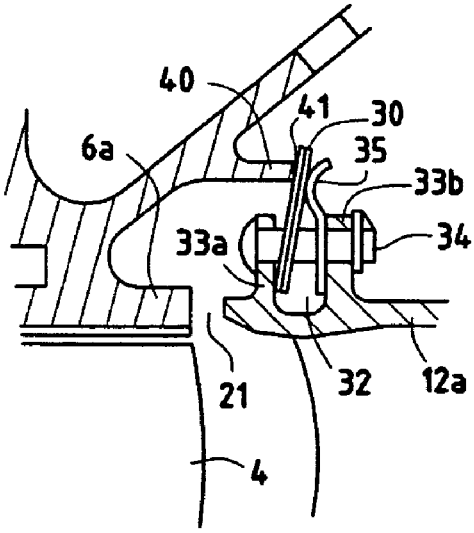
FIG.4 PRIOR ART
Figure 5:
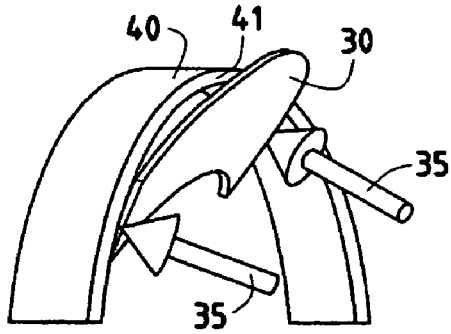
FIG.5 PRIOR ART
Figure 6:
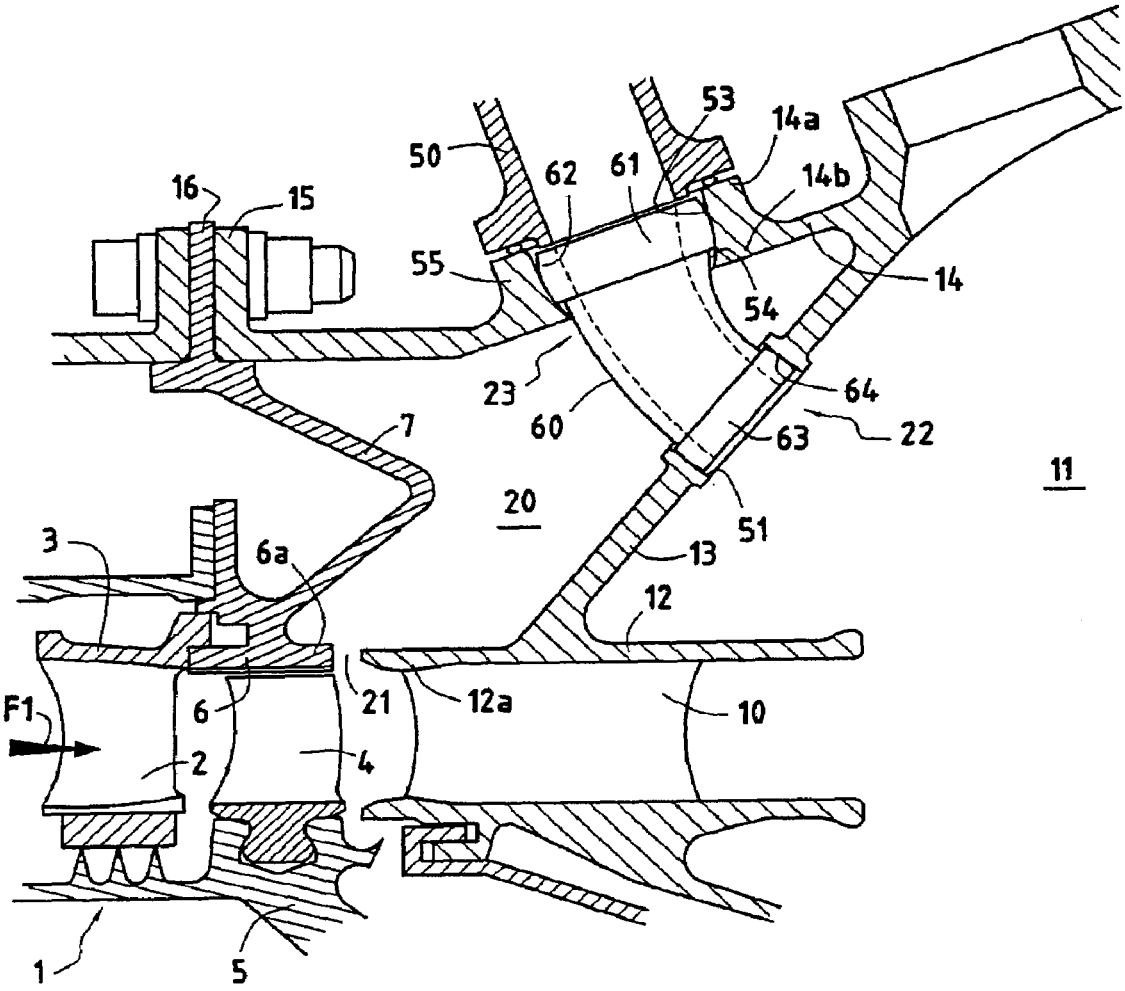
FIG. 6 shows the system for bleeding air to the cabin according to the invention.

FIG. 6 shows the downstream part of a jet engine compressor of which the stator has an external shell 6 externally delimiting the duct for the primary flow, which is connected to an annular structure 7 of V-shaped cross section having a flange 16 at its periphery, and a diffuser grating 10 having an external casing 12 in the continuation of the external shell 6 and the upstream part 12*a* of which delimits a gap 21 with the downstream end 6*a* of the external shell 6 of the compressor.

The external casing 12 of the grating 10 is connected to an oblique strut 13 which is itself connected to an external casing shell 14 which extends in the upstream direction and has a flange 15 at its upstream end. The flange 15 and the flange 16 are fastened to one another by bolting.

The strut 13 has at least one through orifice 22 formed by a cylindrical wall 51. The orifice 22 is used to bleed air from the end of the combustion chamber, especially for the purpose of ventilating the cabin of the airplane.

The external casing shell 14 also comprises an orifice 23, or outlet vent for the supply air, at the inlet of a pipe 50 for supplying a device for aerating the cabin (not shown in the drawing).

The axes of the orifice 23 of the external casing shell 14 and of the orifice 22 in the strut 13 are arranged in a common meridian plane containing the axis of the jet engine.

The orifice 23 is delimited toward the external face 14*a* of the external shell 14 by a cylindrical surface portion 53 and toward the internal face 14*b* of the external shell 14 by a spherical surface portion 54, these two wall portions joining in the mid-plane of the wall of the external casing shell 14, which has a boss 55 around the orifice 23.

A tube 60, passing through the cavity 20, connects the orifice 22 in the strut 13 to the inlet of the pipe 50.

This tube 60 comprises a first end 61 arranged in the orifice 23 in the external shell 14, which has at its periphery a spherical surface portion 62 whose diameter is equal or substantially equal to the diameter of the cylindrical surface portion 53 and spherical surface portion 54 delimiting the orifice 23.

The length of the tube 60 is calculated such that its second end 63 is arranged in the cylindrical orifice 22 in the strut 13. This second end 63 has at its periphery a spherical surface portion 64 whose diameter is equal or substantially equal to the diameter of the cylindrical orifice 22.

The connection between the tube 60 and the strut 13 is thus a swivel connection which allows freedom of translational movement for the end 63 in the direction of the axis of the orifice 22 and rotational freedom about the center of the spherical surface portion 64.

The front face of the first end 61 of the tube 60 is situated at a small distance from the end face of the pipe 50, which prevents the first end 61 of the tube 60 from moving translationally and allows the first end to have a degree of freedom about the center of the spherical surface portion 62. It should be noted that the mouth of the pipe 50 could comprise a spherical bearing surface which bears on the spherical portion 62.

The connection between the tube 60 and the external casing shell 14 is thus produced in the form of a ball joint which is prevented from translational movement but is free to rotate.

The diameter of the orifice 23 is greater than the diameter of the orifice 22 in order to facilitate mounting of the tube 60.

The second end 63 of the tube 60 is inserted into the orifice 23 of the external casing shell 14 by the external face 14*a*.

When the second end 63 is housed in the orifice 22 in the strut, the spherical surface portion 62 of the first end 61 butts against the spherical surface portion 54 of the orifice 23. The installation of the pipe 50 will immobilize the first end 61 in terms of translational movement with respect to the axis of the orifice 23.

The tube 60 is made from a material which has a coefficient of expansion substantially identical to the material constituting the diffuser and, in particular, the strut 13 and the external casing shell 14. This material may in particular be identical to that of the diffuser, which makes it possible to eliminate problems relating to temperature gradient.

The spherical and cylindrical surfaces of the swivel connections can be treated with a product which protects the elements in contact and improves the relative sliding movements. These surfaces may in particular be treated with a graphite-containing ceramic varnish.

The invention claimed is:

1. A jet engine comprising, from an upstream direction to a downstream direction, wherein the upstream and downstream directions are defined by a direction of circulation of a primary flow, said jet engine comprising:

a high-pressure compressor, a diffuser grating and a combustion chamber, said high-pressure compressor comprising an external shell which radially delimits a duct for said primary flow and is connected to an annular structure extending radially outward, said diffuser grating comprising in an axial continuation of said external shell an external casing connected to a rearwardly oriented oblique strut delimiting, upstream, an end of said combustion chamber, said strut itself being connected to an external casing shell which extends in the upstream direction and is fastened to said annular structure by fastening means, said strut, said external casing shell and said annular structure defining a cavity around said diffuser grating, air bleed orifices being made in said strut in order to bring the end of the combustion chamber into communication with said cavity, said external casing shell being equipped with air bleed vents, wherein a tube is provided between an orifice in the strut and an outlet vent, a first end of said tube is mounted in said outlet vent by a connection which is free to rotate and prevented from translational movement, and a second end of said tube is mounted in said orifice by a connection which is free to rotate and free to move translationally.

2. The jet engine as claimed in claim 1, wherein the first and second ends of the tube each comprise a spherical surface portion at their periphery.

3. The jet engine as claimed in claim 2, wherein the orifice in the strut is formed by a cylindrical bore whose diameter is substantially equal to a diameter of the spherical surface portion of the second tube end.

4. The jet engine as claimed in claim 1, wherein the outlet vent comprises an orifice made in a wall of the external casing shell, said orifice being delimited by a cylindrical portion situated toward an external face of said shell and by a spherical surface portion situated toward an internal face and connected to a preceding portion, said cylindrical and spherical surface portions having a diameter which is substantially equal to the diameter of the spherical surface portion of the first tube end.

5. The jet engine as claimed in claim 1, wherein the tube is made of a material having substantially a same coefficient of expansion as a material constituting the strut and the external casing shell.

6. The jet engine as claimed in claim 5, wherein the tube, the strut and the external casing shell are made of the same material.

7. The jet engine as claimed in claim 1, wherein surfaces of the connections are treated with a product which protects elements in contact and improves relative sliding movements.

8. The jet engine as claimed in claim 7, wherein the product is a graphite-containing ceramic varnish.

* * * * *